US010530028B2

(12) United States Patent
Na

(10) Patent No.: US 10,530,028 B2
(45) Date of Patent: Jan. 7, 2020

(54) WAVEGUIDE FILTER FORMED BY A CASING AND A CAP FITTED INTO THE CASING, WHERE A TUNING SHEET IS INTERPOSED BETWEEN THE CAP AND THE CASING

(71) Applicant: KMW INC., Hwaseong-si (KR)

(72) Inventor: In-Ho Na, Seongnam-si (KR)

(73) Assignee: KMW INC., Hwaseong-si (KR)

( * ) Notice: Subject to any disclaimer, the term of this patent is extended or adjusted under 35 U.S.C. 154(b) by 87 days.

(21) Appl. No.: 15/818,692

(22) Filed: Nov. 20, 2017

(65) Prior Publication Data

US 2018/0076497 A1 Mar. 15, 2018

Related U.S. Application Data

(63) Continuation of application No. PCT/KR2016/001056, filed on Feb. 1, 2016.

(30) Foreign Application Priority Data

May 21, 2015 (KR) ..... 10-2015-0071283

(51) Int. Cl.

| | |
|---|---|
| ***H01P 1/20*** | (2006.01) |
| ***H01P 1/208*** | (2006.01) |
| ***H01P 1/207*** | (2006.01) |
| ***H01P 7/06*** | (2006.01) |

(52) U.S. Cl.

CPC ..... *H01P 1/208* (2013.01); *H01P 1/207* (2013.01); *H01P 7/06* (2013.01)

(58) Field of Classification Search

CPC ..... H01P 1/207; H01P 1/208

USPC ..... 333/208, 212

See application file for complete search history.

(56) References Cited

U.S. PATENT DOCUMENTS

| | | | | |
|---|---|---|---|---|
| 4,301,430 | A * | 11/1981 | Stachejko | H01P 1/207 333/158 |
| 2003/0206082 | A1 | 11/2003 | Chen et al. | |
| 2013/0154772 | A1 | 6/2013 | Politi | |
| 2013/0169384 | A1 | 7/2013 | Meuriche | |
| 2014/0176379 | A1 | 6/2014 | Kuo et al. | |

FOREIGN PATENT DOCUMENTS

| | | |
|---|---|---|
| JP | 2003-158401 A | 5/2003 |
| JP | 2004-235731 A | 8/2004 |

OTHER PUBLICATIONS

International Search Report dated May 4, 2016 for PCT/KR2016/001056 and its English translation.

* cited by examiner

*Primary Examiner* — Benny T Lee

(57) ABSTRACT

The present disclosure provides a waveguide filter including a casing configured to form a waveguide having a side wall, a part of which is formed with a through hole, a plurality of partitions configured to form resonance sections by partitioning an interior of the waveguide within the casing, a cap configured to have a body that is fitted within the through hole of the casing so as to define at least a part of an inner region of the waveguide, and to have a head formed to correspond to at least a part of a peripheral region around the through hole of the casing so that the head is coupled with the casing, and at least one tuning sheet configured to be held interposed between the head of the cap and the casing when coupled.

5 Claims, 6 Drawing Sheets

WAVEGUIDE FILTER FORMED BY A CASING AND A CAP FITTED INTO THE CASING, WHERE A TUNING SHEET IS INTERPOSED BETWEEN THE CAP AND THE CASING

CROSS-REFERENCE TO RELATED APPLICATION

This application is a Continuation of International Application No. PCT/KR2016/001056, filed on Feb. 1, 2016, which claims the benefit of and priority to Korean Patent Application No. 10-2015-0071283, filed on May 21, 2015, which are herein incorporated by reference in their entirety.

TECHNICAL FIELD

The present disclosure in some embodiments relates to a radio frequency filter used in a radio communication system. More particularly, the present disclosure relates to a waveguide filter.

BACKGROUND

Recent rapid development of mobile communication systems and mobile communication terminals has caused drastic increase of data amount requested by users. This demands more bandwidth from limited frequency resources for mobile communication systems, which has been addressed, but not in a fully satisfactory manner, by an emerging technology that utilizes millimeter waves having wavelengths in the order of millimeters. The next-generation 5G system which has been discussed recently actually plans to employ small cell backhaul systems utilizing millimeter waves with frequency of, for example, 28 GHz or 60 GHz.

Processing the millimeter waves requires waveguide filters which have been mainly used in technical fields such as defense and satellite communications. Furthermore, in mobile communication systems, a waveguide filter of a cavity type is used so as to be able to satisfy the requirements for high frequency bands and high performance filtering characteristics.

A waveguide filter utilizes a resonance phenomenon caused by its physical structure, in which a tubular waveguide is designed to have a length corresponding to the frequency filtering characteristics thereof. For example, a waveguide filter may be classified into a cavity type which makes use of metal blocks, and a type having a waveguide with a dielectric resonance element, such as ceramic therein. In case of high frequency bands such as millimeter waves, a cavity type waveguide filter has less dielectric loss, and thus is more suitable.

FIG. 1 is an exploded perspective view showing an example of a typical cavity type waveguide filter (main part). Referring to FIG. 1, a cavity type waveguide filter generally includes a first case 10 (e.g., a housing) and a second case 11 (e.g., a cover) as basic components. A plurality of partitions 131, 132, 133, 134, 135, 136, 137, 138 is also provided for implementing the interior of the waveguide based on the relevant filtering frequency.

A cavity type waveguide filter is usually composed of rectangular parallelepiped resonance stages which generate resonance at a desired frequency, and two partitions (also known as, "Iris") installed facing each other for establishing a coupling between the resonance stages. In the example of FIG. 1, the plurality of partitions 131 to 138 forms first to third resonance sections 121, 122 and 123 to be connected in a row in the waveguide. Here, the first resonance section 121 is preceded by a formation of input section 112, and the third resonance section 123 has a trailing output section 114, to provide incoming and outgoing power feeders, respectively. In addition, by appropriately designing the mutual spacing of every two partitions formed facing each other between the respectively resonance sections and the input and output sections, the amount of signal coupling between the sections is appropriately set.

In the above-described waveguide filter, the cross-sectional shape of the waveguide is rectangular (square or rectangular) in some typical cases, where the transverse length (a) and vertical length (b) of the internal cross section of the waveguide influence the cutoff frequency characteristics of the relevant filter, and these lengths can be designed to have virtually normalized numerical values according to the relevant filtering frequency. In addition, according to the wavelength $\lambda$ of the relevant filtering frequency, the waveguide lengths of the first to third resonance sections 121, 122 and 123 along with the input and output sections 112, 114 are appropriately set, so that their waveguide lengths have the values of $\lambda/2$, $\lambda/4$, $\lambda/8$, and so on.

The cavity type waveguide filter as shown in FIG. 1 has a structure in which, for example, the first to third resonance sections 121, 122 and 123 are connected to each other in a row, that is a 3-stage filter structure on one surface. It will be understood by those skilled in the art that the filter may be designed with four or more stages or one or two stages depending on the number of resonance sections connected to each other in a row.

An example of such a cavity type waveguide filter is disclosed in U.S. Patent Publication No. 2003/0206082 (entitled "WAVEGUIDE FILTER WITH REDUCED HARMONICS," inventors: "Ming Hui Chen," "Wei-Tse Cheng," Publication Date: Nov. 6, 2003).

Meanwhile, the first case 10 and the second case 11, as shown in FIG. 1, which constitute the waveguide in the cavity type waveguide filter, may be manufactured by a cutting processing for higher machining precision. At this time, the first case 10 and the plurality of partitions 131-138 are integrally formed from a single base material by machining. The first case 10 and the second case 11 may then be joined together by screw fastening or welding.

In order to compensate for machining tolerance in a waveguide filter having such a structure, it is common to employ a structure in which a frequency tuning screw or bar is inserted into a resonance section of the resonance structure at an appropriate place via, for example, a screw hole or the like formed in the second case 11. Likewise, adjacent paired partitions installed between the resonance sections may be structured to have tuning screws and bars for tuning the coupling between the resonance sections by inserting them into a screw hole or the like formed in the second case 11.

When implementing a waveguide filter for processing millimeter waves, the very short length of the frequency wavelength for processing requires the overall resonance structure to be sized to be very small and adjacent paired partitions installed between the resonance sections to be very closely spaced. This makes it difficult in practice to employ a structure that installs the aforementioned frequency tuning screws and the coupling tuning screws. For example, the distance between two partitions that are installed in pairs between the resonance sections may be less than 1 mm which is too small to actually place a tuning screw therein.

Thus, the difficulty to employ a structure that involves a tuning screw installation when implementing a waveguide filter for processing millimeter waves compels manufacturers to become reliant on a highly precise manufacturing process to have such machining tolerance that does not require a tuning process. In other words, implementing a waveguide filter for processing millimeter waves requires extremely high processing accuracy in order to realize the designed structure into an actual product. For example, the machining tolerance of about 0.01 mm or less may be required at the interval between adjacent paired partitions facing each other.

However, the requirement of very precise machining tolerances aggravates the difficulty of machining work and lengthens the machining time, which results in an increase in machining costs, decreased production yield to render mass production difficult. For the purpose of reducing the processing cost, it is the current practice to reduce the performance of a corresponding filter, or to select and use a filter product that satisfies the required performance after producing a plurality of filters (that is, a product which does not satisfy the required performance is treated as a defective one). Due to these reasons, the market price of high performance waveguide filters remains very high.

DISCLOSURE

Technical Problem

The present disclosure in some embodiments seeks to provide a waveguide filter of a cavity type for enabling or facilitating a tuning process for compensating for machining tolerances even in a miniaturized filter structure for processing millimeter waves.

In addition, the present disclosure in some embodiments seeks to provide a waveguide filter of a cavity type which can maintain high performance while minimizing high-precision machining work even in a miniaturized filter structure for processing different millimeter waves, thereby reducing processing cost and improving yield.

SUMMARY OF THE INVENTION

In order to achieve the above objects, the present disclosure provides a waveguide filter including a casing, a plurality of partitions, a plug structure or a cap, and at least one tuning sheet. The casing is configured to form a waveguide having a side wall, a part of which is formed with a first through hole. The plurality of partitions is configured to form resonance sections by partitioning an interior of the waveguide within the casing. The cap has a body that is fitted within the first through hole of the casing so as to define at least a part of an inner region of the waveguide, and to have a head formed to correspond to at least a part of a peripheral region around the first through hole of the casing so that the head is coupled with the casing. The at least one tuning sheet is configured to be held interposed between the head of the cap and the casing when coupled.

At least some of the plurality of partitions may be formed integrally with the body of the cap.

The casing may have one or more second through holes, and the first through hole and the one or more second through holes are equipped with a plurality of caps and a plurality of tuning sheets respectively. Each of a number of the plurality of caps and a number of the plurality of tuning sheets is identical to a number of the first through hole and the one or more second through holes.

Advantageous Effects

As described above, the cavity-type waveguide filter according to some embodiments of present disclosure enables or facilitates a tuning process for compensating for machining tolerances even in a miniaturized filter structure for processing millimeter waves, thereby providing further miniaturized filter products. Additionally, the cavity-type waveguide filter can maintain high performance while minimizing high-precision machining work, resulting in reduced processing cost and improved yield.

DETAILED DESCRIPTION OF THE INVENTION

Preferred embodiments of the present disclosure will now be described in detail with reference to the accompanying drawings. For the sake of convenience of explanation, the sizes and shapes thereof are somewhat simplified or partly exaggerated in the attached drawings.

Figure 2:
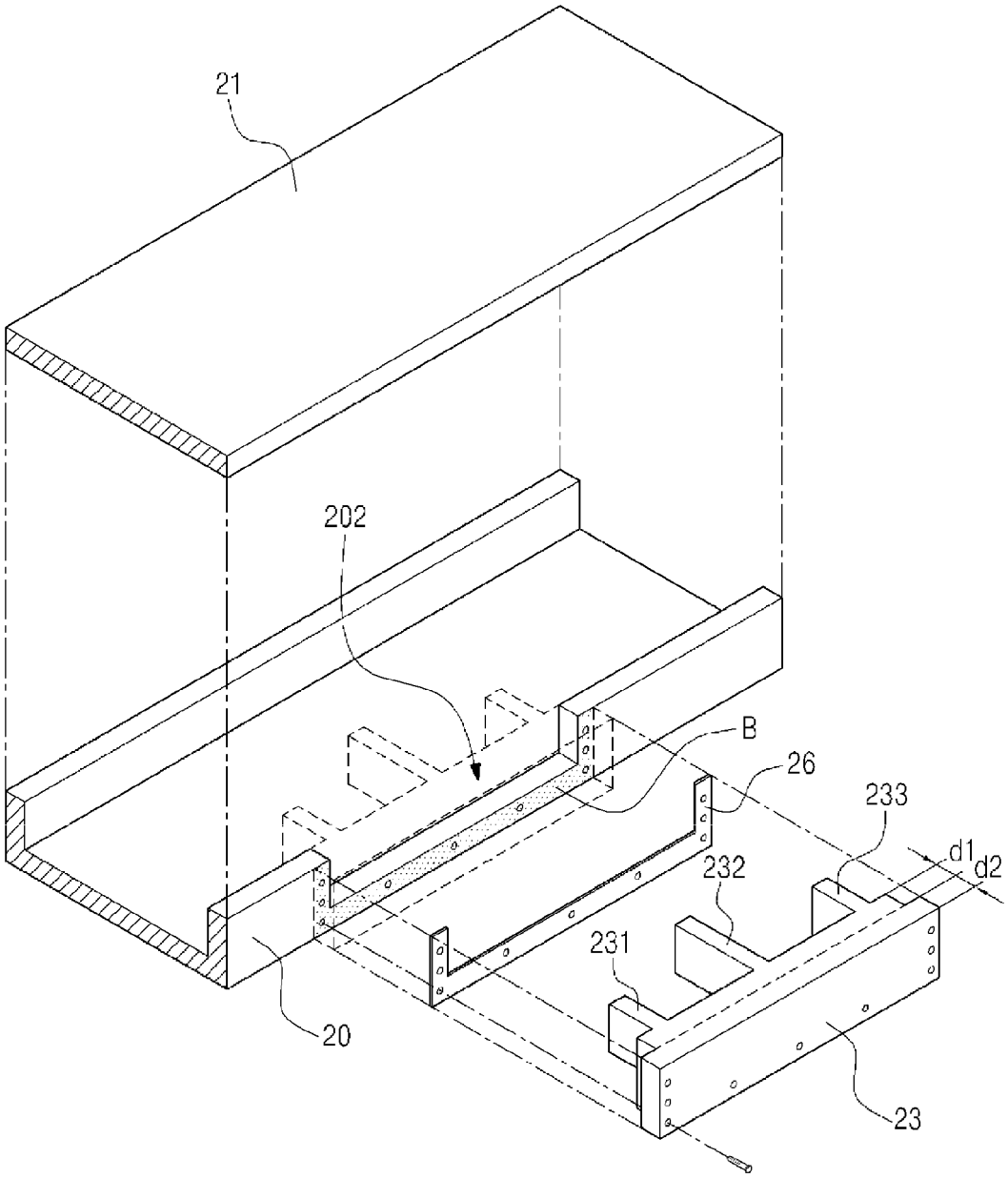
FIG. 2 is an exploded perspective view of a waveguide filter according to a first embodiment of the present disclosure.

FIG. 2 is an exploded perspective view of a major part of the waveguide filter according to the first embodiment of the present disclosure. Referring to FIG. 2, the cavity-type waveguide filter according to the first embodiment of the present disclosure is basically provided with a first case 20 (e.g., a housing) and a second case 21 (e.g., a cover) as elements of a casing to make a waveguide, and also provided with a plurality of partitions 231, 232, 233 which will form one or more resonance sections by partitioning the internal space of the waveguide within the casing according to the corresponding frequency filtering characteristics thereof.

Figure 1:
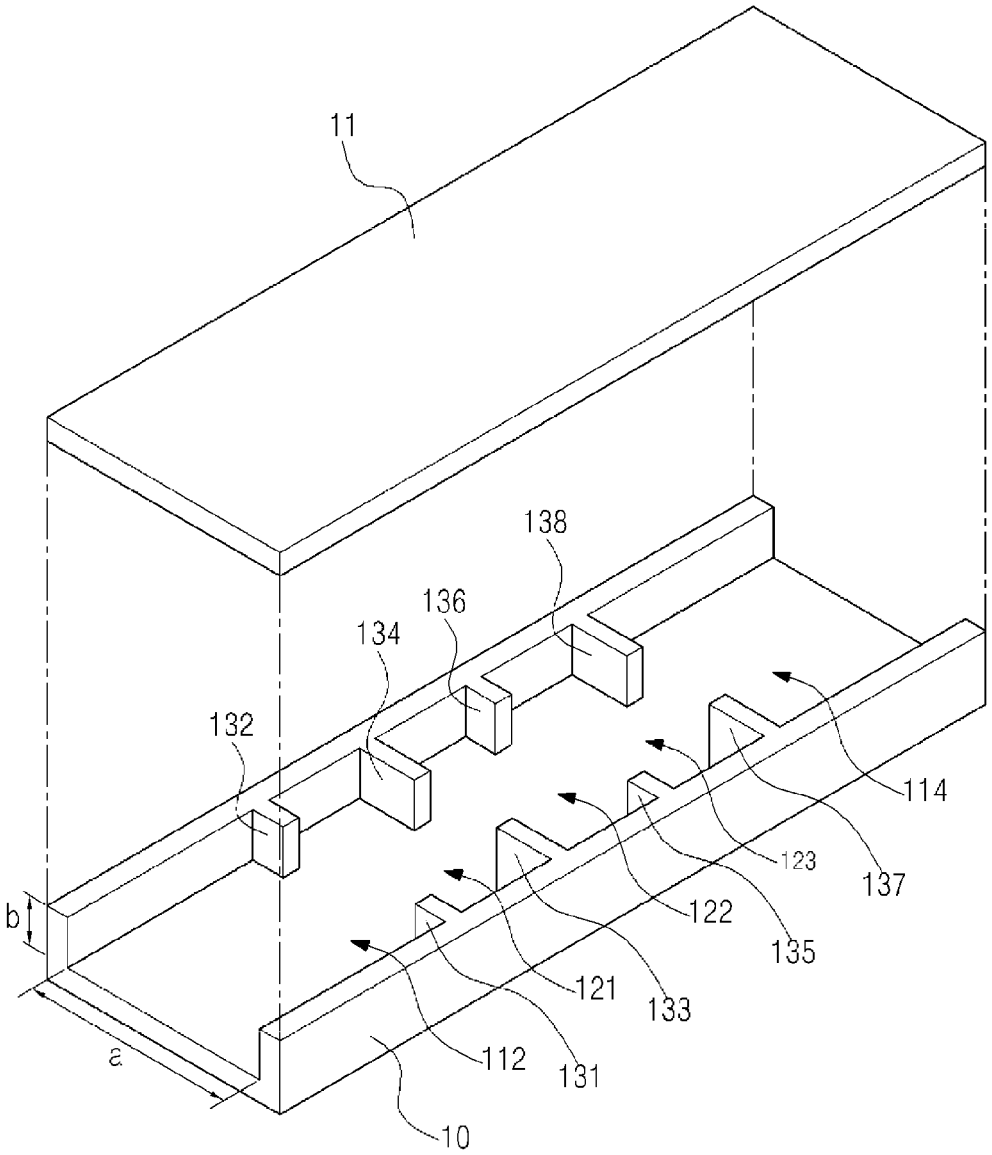
FIG. 1 (PRIOR ART)
FIG. 1 is an exploded perspective view of an example of a typical cavity-type waveguide filter.

However, in the example of FIG. 2, the plurality of partitions 231-233 are illustrated such that they are installed not to be facing each other across the resonance sections but disposed on one side. In this case, one of the partitions 231, 232, 233, for example, is a substitute for each pair of partitions in the structure shown in FIG. 1, and the spacing of the coupling regions formed between the resonance sections by one of the partitions 231, 232, 233 may be designed to correspond to the spacing of the coupling regions formed by the partitions in paired arrangement, for example, as shown in FIG. 1.

The casing, which is formed by the first case 20 and the second case 21 assembled, has a side wall, a part of which is formed (in the example of FIG. 2, at the side wall part of the second case 21) with a through hole 202 through which an outer cap 23 may be inserted by press fitting a body d1 into the through hole 202. The cap 23 is formed in such a structure that the corresponding body d1 is detachably inserted in the through hole 202 formed in the casing. At least some (all in the example of FIG. 2) of the plurality of partitions 231 to 233 are arranged so as to be fixed to the body of the cap 23 or are formed integrated with the body of the cap 23. The cap 23 has a head (d2 in FIG. 2) formed so as to correspond to at least a part of a peripheral region (dot shaded area B in FIG. 2) around the through hole 202 of the casing, and the cap 23 may be configured to be coupled with the casing by a screw fastening method.

It can be understood that at least a part of the side wall of the casing is configured to be detachable to form the body d1 of the cap 23. In addition, it can be understood that the body d1 of the cap 23 defines a portion corresponding to one side in at least a part of a region of the waveguide having a rectangular cross section.

Furthermore, the present disclosure provides a very thin conductive tuning sheet 26 which is interposed between the head (d2 in FIG. 2) of the cap 23 and the engaging portion of the corresponding casing, that is, at least a part of a peripheral region B around the through hole 202 of the casing, and the tuning sheet 26 is joined to the casing together with the cap 23. For example, the head (d2 in FIG. 2) of the cap 23 and the tuning sheet 26 comprise a plurality of screw fastening holes at corresponding positions therein, when appropriate, with a plurality of screw holes being formed at corresponding positions in the casing. In addition, a plurality of fastening screws are respectively fastened to the plurality of screw holes formed in the casing through the plurality of screw holes formed on the head (d2 in FIG. 2) of the cap 23 and the tuning sheet 26.

The tuning sheet 26 is provided for tuning the coupling between the resonance sections, and the placement of the tuning sheet 26 between the cap 23 and the casing results in additional spacing of the coupling region formed between the resonant sections by the plurality of partitions 231 to 233. The tuning sheet 26 in such an arrangement may be formed to have a thickness of, for example, about 0.01 mm or less. At this time, multiple tuning sheets 26 may be interposed to compensate for the spacing variation of the coupling region, or various types of tuning sheets having different thicknesses (and/or different materials) may be prepared in advance so that one of or a combination of multiple tuning sheets 26 may be used.

As described above, the waveguide filter according to the first embodiment of the disclosure shown in FIG. 2 is configured so that it is subject to a design process for forming the partitions 231 to 233 which are the internal coupling structure only on one side surface, and a subsequent process for separately machining the coupling structure formation and assembling the same into the waveguide filter. At this time, the conductive tuning sheet 26 having an appropriate thickness is interposed and assembled together on the surface to which the coupling structure is fastened, to compensate for the spacing variation of the coupling region due to the possible machining tolerance.

The use of tuning sheets remarkably simplifies the processing time of the casing and so reduces the processing time and processing cost. Further, this obviates the need for machining the cap 23 with relatively high precision machining tolerance, and the resultant machining tolerances are such that the thickness of the tuning sheet 26 can be used to compensate for the spacing variation of the coupling region due to machining tolerance. In this case, varying the number of tuning sheets 26 to be fastened or changing the type thereof alone can compensate for machining tolerances and variation from lot to lot, leading to greatly increased production yield. This works advantageously for mass production, and it can strengthen price competitiveness. In addition, using tuning sheets can reduce the time required for coupling tuning, which will lead to reduction of labor costs.

Besides, by varying the configuration of only the cap 23 and the partitions formed in the cap 23 (for example, size, shape, interval, etc.) in the same frequency band, filters with various different filtering characteristics can be manufactured.

Figure 3:
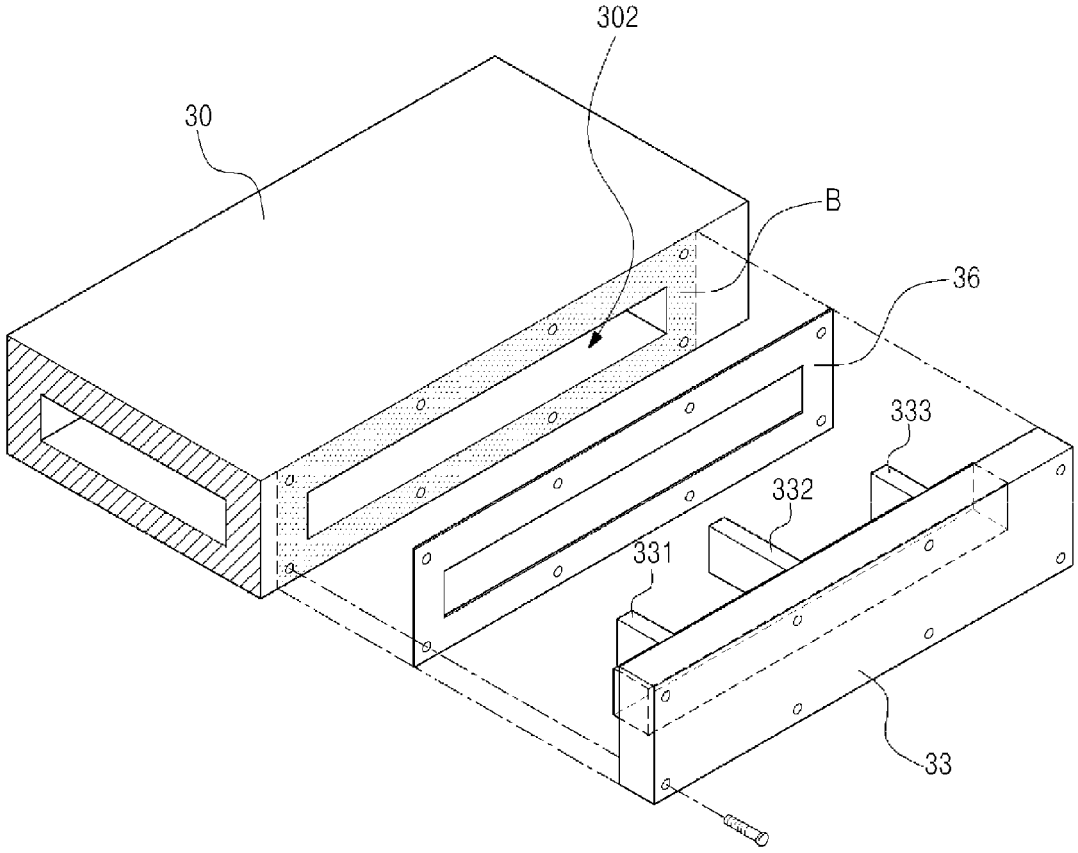
FIG. 3 is an exploded perspective view of a waveguide filter according to a second embodiment of the present disclosure.

FIG. 3 is an exploded perspective view of a waveguide filter according to a second embodiment of the present disclosure. Referring to FIG. 3, the cavity type waveguide filter according to the second embodiment of the present disclosure, similar to the structure of the first embodiment shown in FIG. 2, has a casing 30 to form a waveguide, and a plurality of partitions 331, 332 and 333 which will form resonant sections by dividing the waveguide inside the casing 30 based on the corresponding frequency filtering characteristics thereof. As in the first embodiment shown in FIG. 2, at least one side wall of the casing 30 is provided with a through hole 302 to receive a body of an outer cap 33 when it is inserted. On the body of the cap 33, a plurality of partitions 331 to 333 is integrally formed. A tuning sheet 36 for coupling tuning is interposed between a head of the cap 33 and at least a part of a peripheral region (dot shaded area B in FIG. 3) around the through hole 302 of the casing 30, wherein the cap 33 and the tuning sheet 36 may be configured to be coupled to the casing 30 by a screw fastening method.

The casing 30 of the waveguide filter according to the second embodiment shown in FIG. 3 is different in structure from the first embodiment shown in FIG. 2 where the relevant casing is completed after combining the first and second component cases that are separately manufactured, in that the casing 30 of the second embodiment is integrally formed as a tubular structure through machining or die processing a single base material. This is because some embodiments of the present disclosure wherein the partition structure is formed in a separate cap member, obviate the need for an extra machining to form the partition structure inside the casing 30.

In this way, fabricating a filter with the structure of the second embodiment shown in FIG. 3 remarkably facilitates the manufacture of the casing and reduces the processing tolerances when machining the interior of the waveguide in the casing.

Compared with the first embodiment shown in FIG. 2 in their structures, the casing 30 of the second embodiment shown in FIG. 3 is formed to be thicker as the cap 33 is formed to be thicker. Such a structure makes the manufacturing easier, for example, facilitating to configure a screw fastening structure for coupling the cap 33 and the tuning sheet 36 to the casing 30. In this case, it shall be understood that the internal waveguide structure of the actual corresponding filter may stay the same across the embodiments and that the accompanying filtering characteristics remain unchanged.

Figure 4:
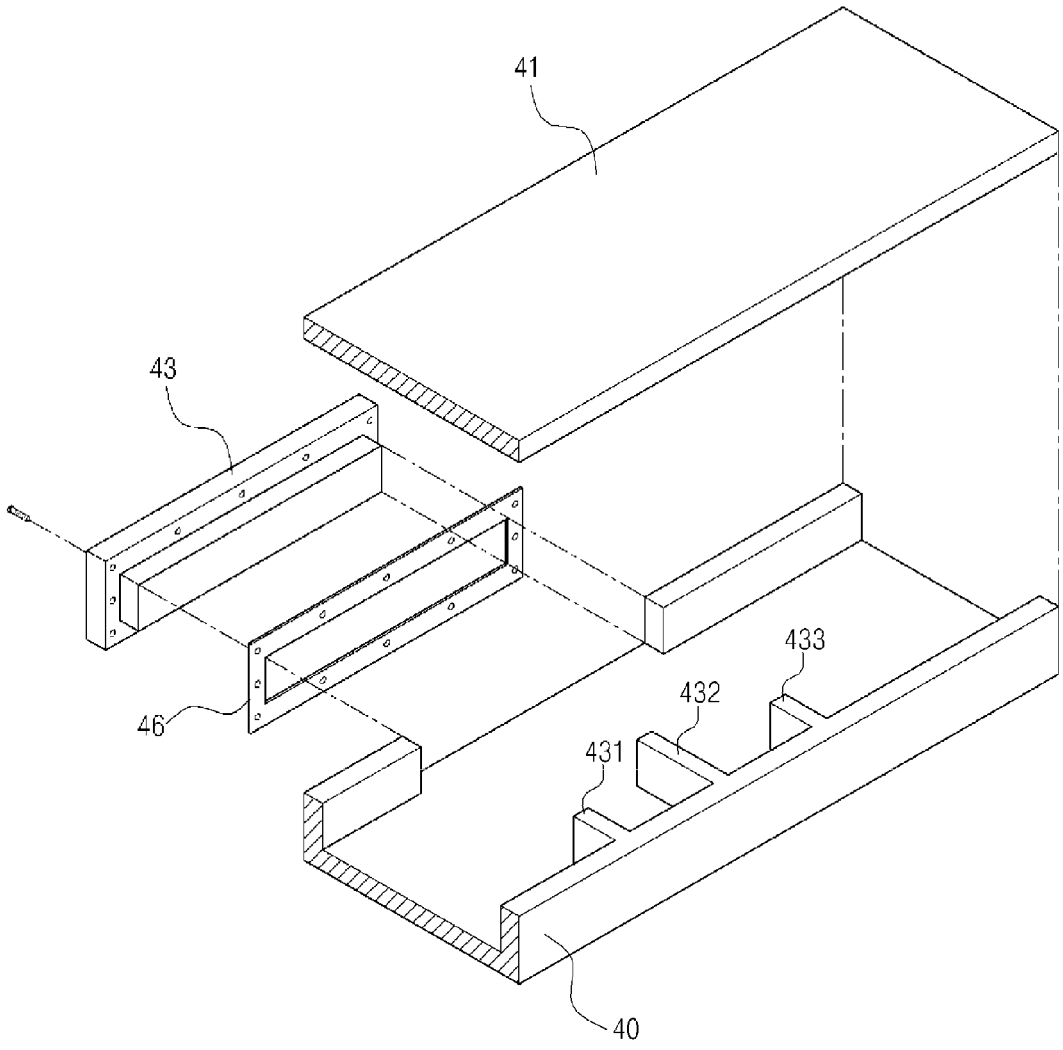
FIG. 4 is an exploded perspective view of a waveguide filter according to a third embodiment of the present disclosure.

FIG. 4 is an exploded perspective view of a waveguide filter according to a third embodiment of the present disclosure. Referring to FIG. 4, the cavity type waveguide filter according to the third embodiment of the present disclosure is similar to the structure of the first embodiment shown in FIG. 2, in that the third embodiment has a first case 40 and a second case 41 for forming a waveguide, and a plurality of partitions 431, 432 and 433 adapted to form resonant sections by dividing the waveguide inside the casing based on the corresponding frequency filtering characteristics thereof. Similar to the second embodiment shown in FIG. 2, a part of the side walls of the casing 40, 41 is provided with a through hole for receiving a body of an outer cap 43 by way of fitting the body into the through hole. A tuning sheet 46 for tuning the coupling is interposed between a head of the cap 43 and the casing 40, 41, wherein the cap 43 and the tuning sheet 46 may be configured to be coupled to the casing 40, 41 by a screw fastening method.

The waveguide filter according to the third embodiment illustrated in FIG. 4 is different in structure from the first embodiment shown in FIG. 2 in that the plurality of partitions 431, 432 and 433 are formed not in the head of the cap 43 but in the case 30 on a side opposite to the side where the cap 43 is inserted. It shall be understood that this embodiment may share the internal waveguide structure of the actual filter with other embodiments and that the accompanying filtering characteristics remain consistent.

Figure 5:
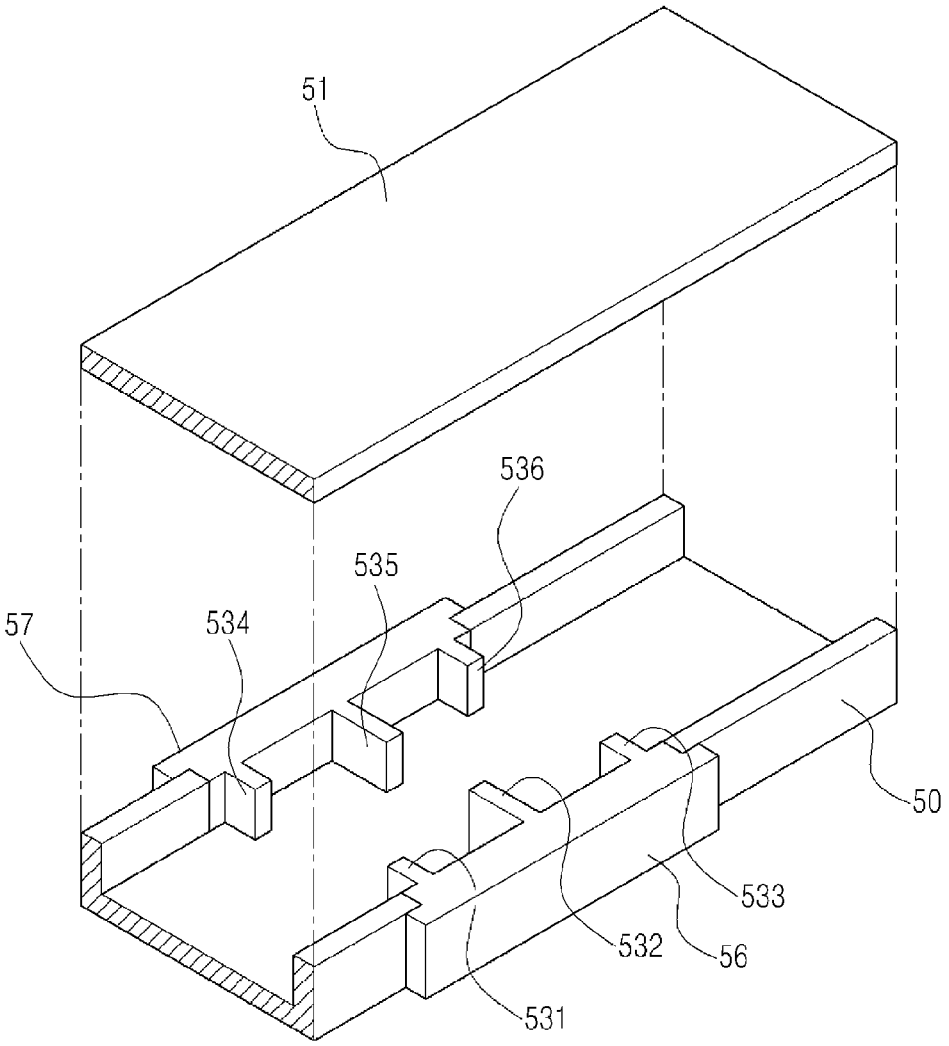
FIG. 5 is an exploded perspective view of a waveguide filter according to a fourth embodiment of the present disclosure.

FIG. 5 is an exploded perspective view of a waveguide filter according to a fourth embodiment of the present disclosure. Referring to FIG. 5, the cavity type waveguide filter according to the fourth embodiment of the present disclosure is similar to the structure of the first embodiment shown in FIG. 2, and the fourth embodiment has a first case 50 and a second case 51 for jointly forming a waveguide, and a plurality of partitions 531, 532, 533, 534, 535, 536 which forms resonance sections by dividing the interior of the waveguide in the casing according to the corresponding frequency filtering characteristics thereof.

In the fourth embodiment shown in FIG. 5, the waveguide filter is provided with two individual through holes formed on opposite sides of the casing 50, 51, and first and second outer caps 56, 57 having the bodies thereof respectively fitted into the two through holes. Of the plurality of partitions 531, 532, 533, 534, 535, 536, the first to third partitions 531-533 may be formed on the first cap 56, and the fourth to sixth partitions 534-536 may be formed on the second cap 57.

This configuration provides a structure in which opposing partitions are formed in pairs in the resonance sections, and it should be understood that tuning of the coupling from the opposite sides can be accomplished through this configuration.

It should be understood that tuning sheets (not shown) for tuning the coupling are interposed between respective heads of the first and second caps 56, 57 and the case 50, wherein the first and second caps 56, 57 and the tuning sheets may be configured to be coupled to the case 50 by a screw fastening method.

Figure 6:
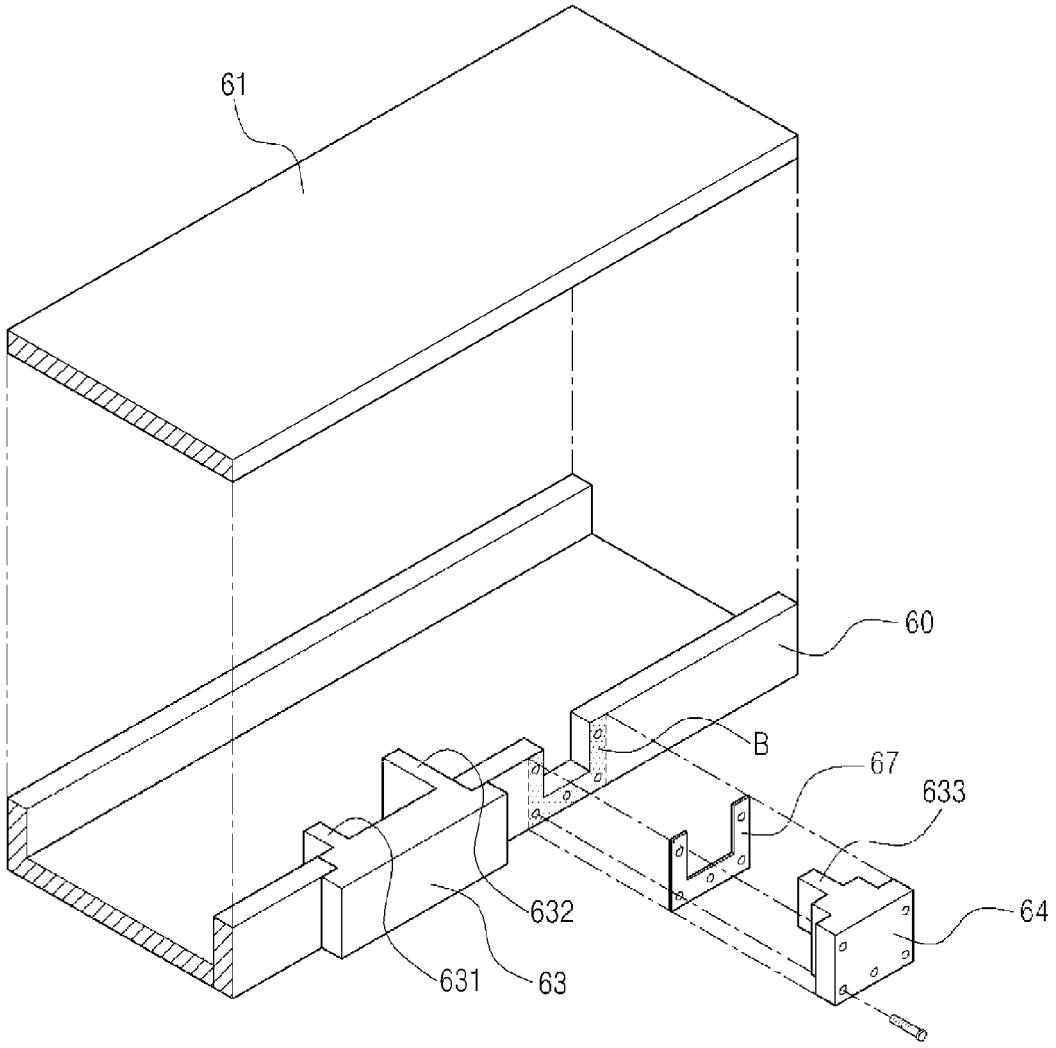
FIG. 6 is an exploded perspective view of a waveguide filter according to a fifth embodiment of the present disclosure.

FIG. 6 is an exploded perspective view of a waveguide filter according to a fifth embodiment of the present disclosure. Referring to FIG. 6, the cavity type waveguide filter according to the fifth embodiment of the present disclosure is similar to the structure of the first embodiment shown in FIG. 2, and the fifth embodiment has a first case 60 and a second case 61 for jointly forming a waveguide, and a plurality of partitions 631, 632, 633 which forms resonance sections by dividing the interior of the waveguide in the casing according to the corresponding frequency filtering characteristics thereof.

In the fifth embodiment shown in FIG. 6, the waveguide filter is provided with two individual through holes formed on one side of the casing 60, 61, and first and second outer caps 63, 64 having respective bodies fitted into the two corresponding through holes. Of the plurality of partitions 631, 632, 633, the first and second partitions 631, 632 may be formed on the first cap 63, and the third partition 633 may be formed on the second cap 64.

This structure is configured to allow coupling tuning to be carried out individually at multiple locations on one side in the waveguide.

FIG. 6 also illustrates that a tuning sheet 67 for coupling tuning is interposed between a head of the second cap 64 and the case 60 at a part of a peripheral region (dot shaded area B in FIG. 6), and likewise a tuning sheet (not shown) is interposed between the first cap 63 and the case 60.

The waveguide filter of the cavity type according to some embodiments of the present disclosure may be constructed as described above, while the present disclosure may have various other embodiments and modifications. For example, it can be seen that the number of resonance sections in each of the filter structures described above can be variously designed as necessary.

In the fourth embodiment of FIG. 5, both of the first and second caps 56, 57 are illustrated with partition formations, although the partitions may be formed on one of the first and second caps 56, 57 to work quite well.

In the illustrated embodiments, the caps and the tuning sheets are detachably installed on the left side and/or the right side of the casing (on the drawing), but the caps and the tuning sheets may be detachably installed on the upper side and/or the lower side of the casing in a detachable manner.

As described above, various modifications and changes of the present disclosure are possible, and therefore the scope of the present disclosure is not to be limited by the explicitly described above embodiments but to be defined by the claims and equivalents thereof.

The invention claimed is:

1. A waveguide filter, comprising:

a casing configured to form a waveguide having a side wall, a part of which is formed with a first through hole;

a plurality of partitions configured to form resonance sections by partitioning an interior of the waveguide within the casing;

a cap configured to have a body that is fitted within the first through hole of the casing so as to define at least a part of an inner region of the waveguide, and to have a head formed to correspond to at least a part of a peripheral region around the first through hole of the casing so that the head is coupled with the casing; and at least one tuning sheet configured to be held interposed between the head of the cap and the casing when coupled.

2. The waveguide filter according to claim 1, wherein at least some of the plurality of partitions are integrally formed with the body of the cap.

3. The waveguide filter according to claim 2, wherein the tuning sheet has a thickness of 0.01 mm or less.

4. The waveguide filter according to claim 1, wherein the casing is integrally formed as a tubular structure through machining a single base material.

5. The waveguide filter according to claim 1, wherein the casing has one or more second through holes, and the first through hole and the one or more second through holes equipped with a plurality of caps and a plurality of tuning sheets respectively, wherein each of a number of the plurality of caps and a number of the plurality of tuning sheets is identical to a number of the first through hole and the one or more second through holes.

* * * * *